United States Patent [19]

Thompson

[11] 4,152,689

[45] May 1, 1979

[54] ELECTRICAL RESISTOR PACKAGE WHICH REMAINS UNAFFECTED BY AMBIENT STRESSES AND HUMIDITY

[75] Inventor: Edward E. Thompson, Westmont, N.J.

[73] Assignee: American Components Inc., Conshohocken, Pa.

[21] Appl. No.: 877,251

[22] Filed: Feb. 13, 1978

[51] Int. Cl.[2] ..... H01C 1/02

[52] U.S. Cl. ..... 338/254; 338/226

[58] Field of Search ..... 338/254, 255, 257, 226, 338/230, 243, 262, 283, 287, 288, 292, 293, 334; 29/613, 588, 627; 427/102, 103

[56] References Cited

U.S. PATENT DOCUMENTS

| | | | |
|---|---|---|---|
| 2,448,856 | 9/1948 | Bohannon | 338/230 |
| 2,734,978 | 2/1956 | Bulgin | 338/262 X |
| 3,405,381 | 10/1968 | Zandman et al. | 338/254 |
| 3,517,436 | 6/1970 | Zandman et al. | 29/613 |

*Primary Examiner*—C. L. Albritton

*Attorney, Agent, or Firm*—William E. Cleaver

[57] ABSTRACT

The present electrical resistor package has a naked electrical resistor element which is designed to provide quantitative resistance to electrical current flow, said element is initially encapsulated in a flexible coating, such as silicone wax, which absorbs stresses and is secondarily encapsulated around said flexible coating, in a cushion type moisture barrier coating, such as silicone rubber, to keep moisture away from said element and finally is encapsulated around said moisture barrier coating by a hard protective coating, such as epoxy, to protect the nak ed element from physical and environmental damage.

4 Claims, 2 Drawing Figures

ELECTRICAL RESISTOR PACKAGE WHICH REMAINS UNAFFECTED BY AMBIENT STRESSES AND HUMIDITY

BACKGROUND

In the design of electrical resistors, packaged for use in radios, computers, space equipment or electronics gear in general, there is an ongoing common design problem. Irrespective of whether the electrical resistor is from the carbon, carbon-resin, metal film, metal foil or metal oxide varieties, the resistor element should be protected from stresses which can change the value of the resistance or from moisture which can ultimately change the resistance value. If the resistor element is subjected to stresses, the resistance path literally changes and so the value of the resistance changes. On the other hand, any trace of water or water vapor causes deleterious effects in resistors resulting in oxidation or electrolysis upon application of a small load or polarizing voltage. When the latter phenomenon occurs, the stability of the resistor is affected and there is a continued increase in resistance until the component eventually opens and a catastrophic failure takes place. Obviously the manufacturer and the user of electrical resistors would prefer to have electrical resistors which do not become affected by either stress or humidity.

There have been many attempts to protect resistors from the humidity, the U.S. Pat. No. 4,010,440 assigned to the assignee of this application being an example. However, such attempts have not included the feature to also protect the resistor from stresses. On the other hand there have been some attempts to protect the resistor package from mechanical forces, the U.S. Pat. No. 3,405,381 being an example. However, in the U.S. Pat. No. 3,405,381 the naked element is encapsulated in an epoxy or plastic coating as a moisture barrier before being encapsulated in a soft material, and hence the stresses which are generated by heat can cause distortions in the resistance value because of the difference in temperature coefficient of expansion between the epoxy coating, coming in contact with the naked substrate, and the substrate.

SUMMARY

The present resistor package encapsulates the naked resistor element in a silicone wax. The silicone wax has the advantage that not only is it soft and will not retain moisture such as a sponge does, but has the characteristic that it will not adhere to other coatings such as epoxy, polyester, glyptal, etc., whereby any stresses transmitted to a coating overlaying the silicone wax should not be transmitted through the wax to the naked element. The silicone wax layer is further encapsulated in a layer of silicone rubber which forms a moisture barrier. By having a flexible moisture barrier encapsulating a non-adhering stress barrier the naked element is protected from humidity and stresses and there are no critical values of temperature coefficient between layers required. Finally, the flexible moisture barrier is encapsulated in a hard housing of moulded epoxy to provide protection against direct mechanical forces as contrasted to a shear force, or compression force or the like.

The objects and features of the present invention will be better understood when the following description is studied in view of the figures, in which.

Figure 1:
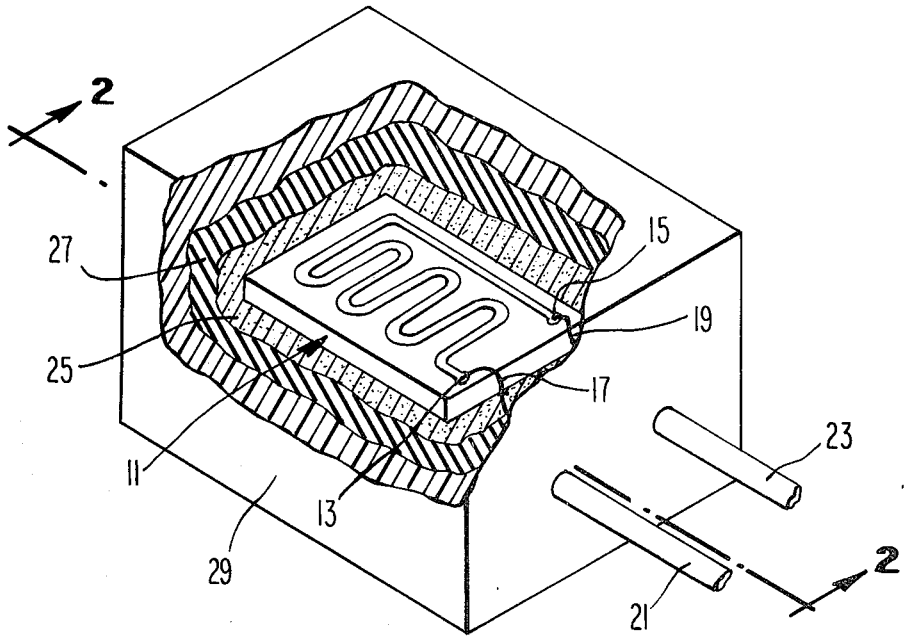
FIG. 1 is a pictorial schematic of the present resistor package.

Consider FIG. 1 which depicts a pictorial schematic of the present invention. In FIG. 1 there is shown a foil type resistor 11 which constitutes a naked electrical resistor element. A foil type resistor may have an irregular path of resistance material bonded to its upper surface. In between the irregular path of the resistance material there is a naked substrate. At the end of the irregular path there are formed two termination land areas 13 and 15 to which there are attached two very thin wires 17 and 19 to insure that no mechanical stresses will be applied through the wire to the termination land area. The light wires 17 and 19 may be soldered or welded to larger gauge wires 21 and 23 which serve as the terminals for the resistor package. As can be better seen in FIG. 2, the naked foil resistor element 11 is encapsulated in a flexible layer 25 of silicone wax. The coating of silicone wax acts to absorb any stress or mechanical energy which might otherwise be applied to the resistor element 11. By preventing any stresses from being applied to the resistor element 11 the resistance value of the element remains constant and stability in resistance values is a highly desirable. In addition, by not encapsulating the naked resistor element 11 in a hard coating such as epoxy or plastic, there is no design concern about mismatch in temperature coefficients of expansion which mismatch leads to unstable resistance values. It should also be noted that by using a silicone wax there is virtually no adhesion between the layer of material encapsulating the naked resistor and the moisture barrier 27 which surrounds the silicone wax. The foregoing is true because the silicone wax has the characteristic of not adhering to materials such as rubber, epoxy, polyester, glyptal, etc.

Figure 2:
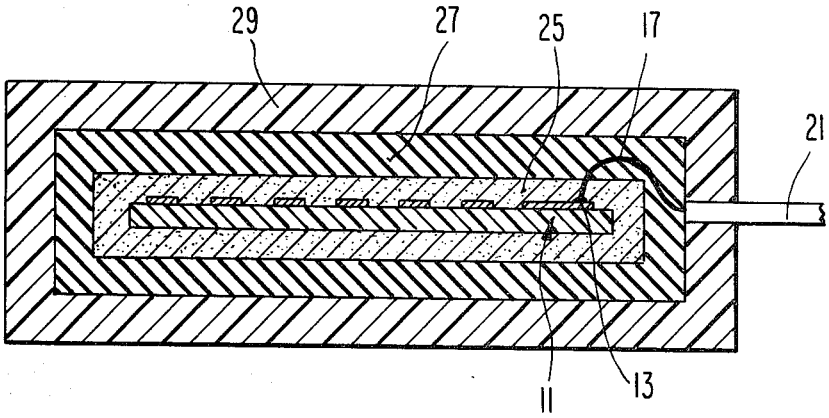
FIG. 2 is a cross section through FIG. 1 taken along lines 2—2.

As can be further gleaned from FIGS. 1 and 2, the layer of silicone wax is surrounded by a moisture barrier layer of silicone rubber although other suitable flexible layers of moisture barrier material could be used. The layer of barrier material 27 serves to keep humidity from passing from outside the package to the silicone wax layer and of course therethrough to the naked resistor element. By choosing a moisture barrier of flexible material such as silicone rubber, the package has an added layer of energy absorbing material and hence any mechanical forces or stress passed through the hard housing 29 will be absorbed in whole or in part by the flexible moisture barrier layer 27.

By employing first a flexible layer of silicone wax to encapsulate the naked resistor and then a second flexible layer of silicone rubber as a moisture barrier to encapsulate the wax layer, the resistor element is protected from both stress and humidity and there is no requirement of matching temperature coefficients of expansion as there has been in resistor packages wherein the naked resistor element is first encapsulated in an epoxy resin. As can be further noted from FIGS. 1 and 2 the thin wires 17 and 19 are encapsulated by the flexible layers of silicone wax and silicone rubber which reduces any damage to those thin wires because of mechanical forces. This feature is an advance over arrangements wherein the lead wires are first encapsulated in hard material such as epoxy.

Finally the moisture barrier layer is disposed within a molded epoxy housing 29. The housing 29 is a hard material and serves as an initial means to hermetically seal the inner contents and an initial means to mitigate any mechanical forces applied to the package. The housing 29 serves its most useful role in preventing damage to the package from handling or transporting or packaging or the like wherein the resistor package can be physically damaged.

The present arrangement of first encapsulating the naked resistor element in a flexible silicone wax layer, which absorbs mechanical energy directed to the naked element and which provides a floating type of phenomenon because of its characteristic to not adhere, plus the second flexible layer of moisture barrier material surrounding the silicone wax, provide a means to protect the naked element from both mechanical stress and the ravages of humidity while simultaneously reducing the criticality of design because there is no concern about mismatch between hard coverage over the naked substrate.

Now it should be borne in mind that while I have described my invention by a preferred embodiment of a metal foil resistor, other types of resistors such as a metal film resistor or a carbon film resistor could be employed. It should also be noted that a layer of silicone could be used instead of a layer of silicone wax.

I claim:

1. An electrical resistor package comprising in combination:

a substrate means; electrical current conducting material formed to provide resistance to electrical current conduction and formed into a particular path, said electrical current conducting material secured to said substrate to provide a naked electrical resistor element; a first layer of flexible material having a silicone base formed to encapsulate said naked electrical resistor element; a second layer of flexible material having a silicone rubber base and characterized by being a moisture barrier formed to encapsulate said first layer of flexible material; hard material housing means formed to surround said second layer of flexible material; and electrical lead means connected to said naked electrical resistor element and mounted to extend from said hard material housing means, whereby said naked electrical resistor element is protected from the effects of stress and humidity.

2. An electrical resistor package according to claim 1 wherein said electrical current conducting material is metal foil formed into a zigzag patch.

3. An electrical resistor package according to claim 1, wherein said first layer of flexible material is composed of silicone wax having the property of being non-adhesive.

4. An electrical resistor package according to claim 1 wherein said electrical lead means comprise a pair of thin metal ribbons secured to the ends of said path of electrical conducting material and a pair of relatively heavy gauge wires connected to said metal ribbons and mounted to extend from said hard material housing.

* * * * *